United States Patent [19]

Marinus

[11] Patent Number: 4,969,176

[45] Date of Patent: Nov. 6, 1990

[54] X-RAY EXAMINATION APPARATUS HAVING A STRAY RADIATION GRID WITH ANTI-VIGNETTING EFFECT

[75] Inventor: Johannes L. M. Marinus, Eindhoven, Netherlands

[73] Assignee: U.S. Philips Corporation, New York, N.Y.

[21] Appl. No.: 496,059

[22] Filed: Mar. 16, 1990

Related U.S. Application Data

[63] Continuation of Ser. No. 319,007, Mar. 3, 1989, abandoned.

[30] Foreign Application Priority Data

Mar. 18, 1988 [NL] Netherlands ..... 8800679

[51] Int. Cl.[5] ..... G21K 1/02

[52] U.S. Cl. ..... 378/149; 378/147; 378/154

[58] Field of Search ..... 378/149, 148, 147, 154, 378/19, 2

[56] References Cited

U.S. PATENT DOCUMENTS

| | | | |
|---|---|---|---|
| 2,407,938 | 9/1946 | Schönander | 378/154 |
| 2,638,554 | 5/1953 | Bartow et al. | 378/147 |
| 3,373,286 | 3/1968 | Han | 378/147 |
| 3,748,470 | 7/1973 | Barrett | 378/2 |
| 3,793,520 | 2/1974 | Grenier | 378/149 |
| 4,020,356 | 4/1977 | Brahme | 378/149 |
| 4,220,890 | 9/1980 | Beekmans | 313/240 |
| 4,825,454 | 4/1989 | Annis et al. | 378/147 |

FOREIGN PATENT DOCUMENTS

| | | | |
|---|---|---|---|
| 0268838 | 10/1929 | Italy | 378/154 |
| 0623547 | 9/1979 | U.S.S.R. | 378/147 |

*Primary Examiner*—Carolyn E. Fields
*Assistant Examiner*—David P. Porta
*Attorney, Agent, or Firm*—Jack E. Haken

[57] ABSTRACT

In apparatus for radiographic diagnostics an X-ray beam attenuated by an object to be examined is converted into a light image by means of an X-ray image intensifier tube. Inter alia as a result of the geometry of the X-ray beam and of the input screen of the X-ray image intensifier tube the intensity of the image decreases towards the edge (vignetting). By arranging a stray radiation grid, for example, in the form of a perforated plate of X-ray-absorbing material, for example, lead or tungsten, in the path of radiation between the X-ray source and the X-ray image intensifier tube, vignetting can be reduced by an adapted variation of the local transmission of the stray radiation grid.

7 Claims, 3 Drawing Sheets

Figure 1:
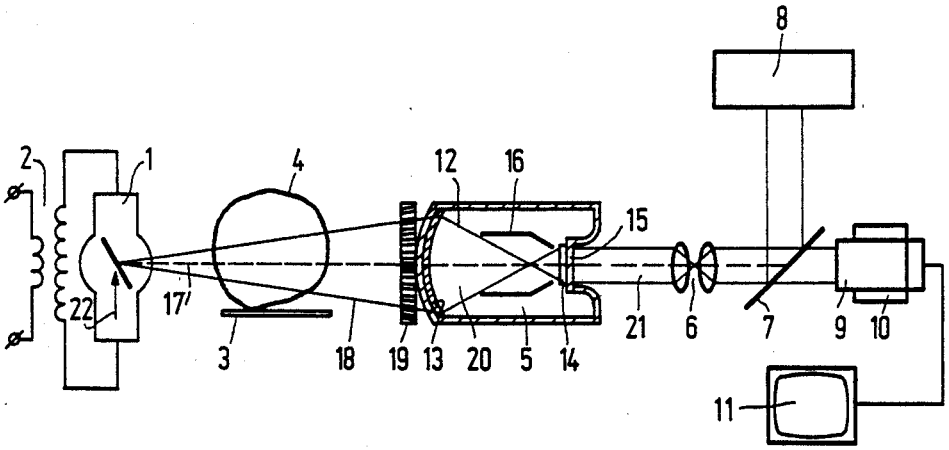

X-RAY EXAMINATION APPARATUS HAVING A STRAY RADIATION GRID WITH ANTI-VIGNETTING EFFECT

This is a continuation of application Ser. No. 319,007, filed March 12 1989, now abandoned.

The invention relates to an X-ray examination apparatus comprising a stray radiation grid accommodated between an X-ray source and an X-ray detection screen and to a stray radiation grid for such an examination apparatus.

Such an X-ray examination apparatus os disclosed in U.S. Pat. No. 4,220,890.

In this known apparatus a beam of X-ray for radiography of a patient to be examined is weakened by the said patient. Loss of brightness at the edges of an image to be displayed (vignetting) occurs, for example, by variations in intensity in an X-ray beam emitted by an X-ray source, by the geometry of the image-forming X-ray beam, the geometry of the X-ray detection screen—for example, the input screen of an X-ray image intensifier tube—, by the substantially cylindrical shape of the patient, and in the combination image intensifier tube-television camera tube-television monitor. As a result of this the diagnostic value of the image is impaired. Upon radiographing a patient to be examined further secondary radiation (also termed stray radiation) is liberated the direction of propagation of which is arbitrary and which impairs the quality of the X-ray image to be formed. In the known apparatus a stray radiation grid is arranged between a patient to be examined and a detection screen as a result of which the intensity of the stray radiation can be reduced.

It is the object of the invention to avoid the vignetting without drawbacks for the picture quality and without undesired adaptation of the tube geometry. For that purpose an X-ray examination apparatus of the type mentioned in the opening paragraph is characterized in that the stray radiation grid has such a transmission variation that a substantially vignetting-free image is formed. Since according to the invention the stray radiation grid mitigates vignetting of the output image, adaptations of the detection screen—which are often undesired and/or difficult to construct—are avoided.

It is to be noted that it is known per se that by varying the thickness of a luminescent screen in an X-ray image intensifier tube in the radial direction, vignetting can be mitigated. U.S. Pat. No. 4,645,971 discloses an X-ray image intensifier tube the thickness of which of the luminescent screen decreases in the radial direction. As a result of this it can be achieved that the path covered by the X-ray beams through the luminescent material is substantially equal throughout the screen and that the luminous efficiency over the luminescent screen is more uniformly distributed. A drawback of such a contruction is that the freedom in the geometry of the tube is restricted and that the resulting power over the screen is detrimentally influenced by said geometry. Moreover, an X-ray image intensifier tube cannot be optimized simultaneously for several types of X-ray examination apparatuses. Nor can this solution be used if the image-carring X-ray beam is detected with a film foil.

In an X-ray examination apparatus using a film foil as a detection screen a stray radiation grid can be incorporated with a local absorption variation which is adapted only to the beam geometry all this based on negligible absorption thickness of the said foil.

In an X-ray examination apparatus in which the detection screen is an input screen of an X-ray image intensifier tube having a uniform thickness and a given local radius of curvature, vignetting can be mitigated by adapting the local transmission of the stray radiation grid to the absorption of the input screen which depends inter alia on the local radius of curvature. With a thickness of the input screen of an X-ray image intensifier tube decreasing in a radial direction and resulting from, for example, a method of providing the luminescent layer in the tube, a partly anti-vignetting effect can be obtained. By adapting the local transmission of the stray radiation grid, remaining vignetting, if any, can be reduced to any desired extent or the thickness variation of the screen can be optimized on other grounds, for example, with respect to resolving power, and the vignetting occurring can be mitigated.

A preferred embodiment of an X-ray examination apparatus according to the invention in characterized in that the stray radiation grid shows a transmission which varies from the centre towards the periphery.

In a further preferred embodiment of the invention the stray radiation grid is formed by a perforated plate of an X-ray radiation-absorbing material. In this plate, consisting, for example, of lead or tungsten, the pitch of the holes may vary from the centre towards the edge or, with constant pitch of the holes, the diameter of the holes may vary from the centre towards the edge, or both variations may be used collectively.

In particular, the plate of X-ray radiation-absorbing material is perforated projectively from a focal point of the X-ray source. The curvature of the stray radiation grid may be adapted to the input window of an X-ray image intensifier tube and be mounted against it.

A further preferred embodiment of the invention is characterized in that a plate of X-ray radiation-absorbing material which is concave viewed from a focal point of the X-ray source has a centre of curvature which coincides with the focal point of the X-ray source. It is to be noted that a method of making stray radiation grids in the form of a perforated plate is known per se from German Offenlegungsschrift DE No. 3124998.

In a further preferred embodiment the stray radiation grid is formed by substantially parallel laminations of X-ray radiation-absorbing material having a mutual distance which varies from the centre towards the edge. A material which is transparent to X-ray radiation, for example, cardboard, may be present between the said laminations. Said grids show a variation in the transmission only in one direction. By using two such lamination grids which are mounted mutually perpendicularly and at a small distance from each other, a grid is formed having a mesh width which varies from the centre towards the edge in all directions.

The invention will now be described in greater detail with reference to the accompanying drawing, in which FIG. 1 shows diagrammatically an X-ray examination apparatus according to a preferred embodiment of the invention, FIGS. 2*a, b*, care diagrammatic front elevations of a few preferred embodiments of a stray radiation grid according to the invention, FIG. 3 is a diagrammatic cross-sectional view of a few preferred embodiments of a stray radiation grid according to the invention.

FIG. 1 show an X-ray source 1 having a high-voltage supply 2, a patient table 3 for a patient 4 to be examined, an X-ray image intensifier tube 5, a basic objective 6, a semi-permeable mirror 7, a film camera 8, a television camera tube 9 having a deflection coil 10 and a television monitor 11. The X-ray image intensifier tube comprises an input window 12 having a luminescent screen 13 provided on the inside which comprises a photoemissive layer and an electron optical system an output screen 14 of which provided on the inside of an output window 15 and one or several intermediate electrodes 16 form part. An incident X-ray beam 17 radiographs the patient 4 and a transmitted image-carrying X-ray beam 18 impinges on the stray radiation grid 19. X-ray radiation the direction of which differs from that of the image-carrying X-ray beam, the so-called stray radiation, is absorbed by stray radiation grid 19. The X-ray beam 18 incident on the luminescent screen 13 is transformed into a beam of photoelectrons 20 which are accelerated and displayed on the output screen 14. An image-carrying light beam 21 emanates via the output window 15 with which a photographic plate can be exposed or a television image can be formed in this case via the semi-permeable mirror 7.

The local transmission of stray radiation grid 19 according to the invention is a such a nature that in the absence of patient 4 an unattenuated X-ray beam 17 incident on stray radiation grid 19 in luminescent screen 13 is transformed into a light image of substantially uniform intensity. For this purpose the transmission of the stray radiation grid 19 is adapted inter alia to the radius of curvature of luninescent screen 13 and to the distance from the luminescent screen to the focus 22 of the X-ray source.

Figure 2A:
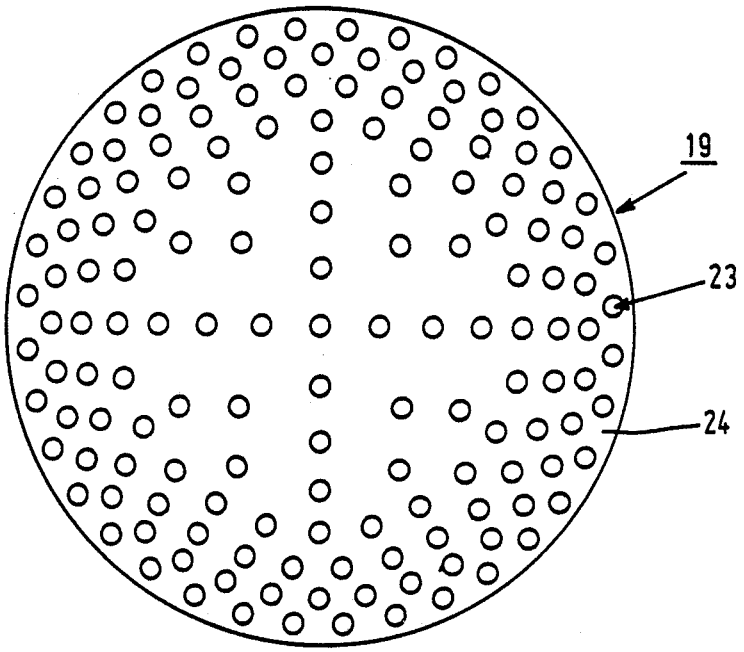
Figure 2B:
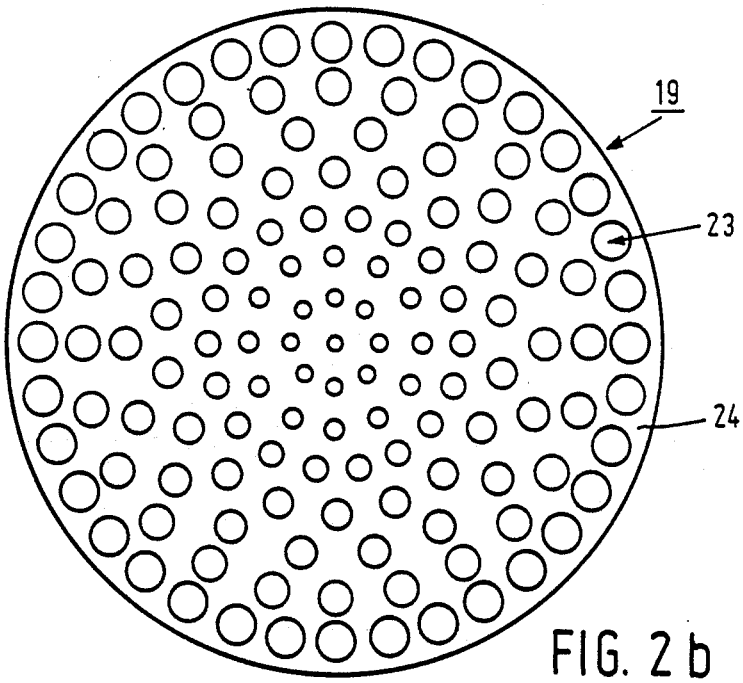
Figure 2C:
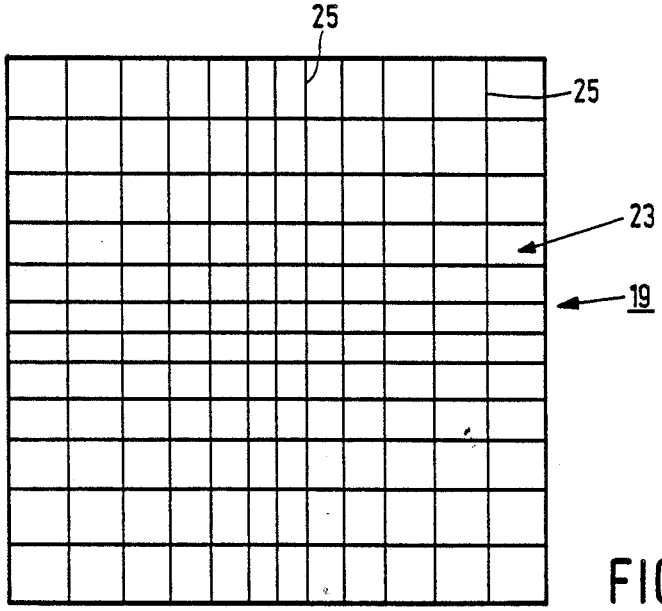

FIG. 2*a* and FIG. 2*b* show a stray radiation grid 19 the transmission of which increases towards the edge. In FIG. 2*a* this has been realized by a density of perforations 23 in the X-ray absorbing plate 24 increasing towards the edge and in FIG. 2*b* this has been realized by the diameter of perforations in the X-ray-absorbing plate 24 increasing in the radial direction. FIG. 2*c* shows a stray radiation grid consisting of laminations 25 placed at right angles to each other and the mutual distance of which increases in two mutually transversal directions.

Figure 3A:
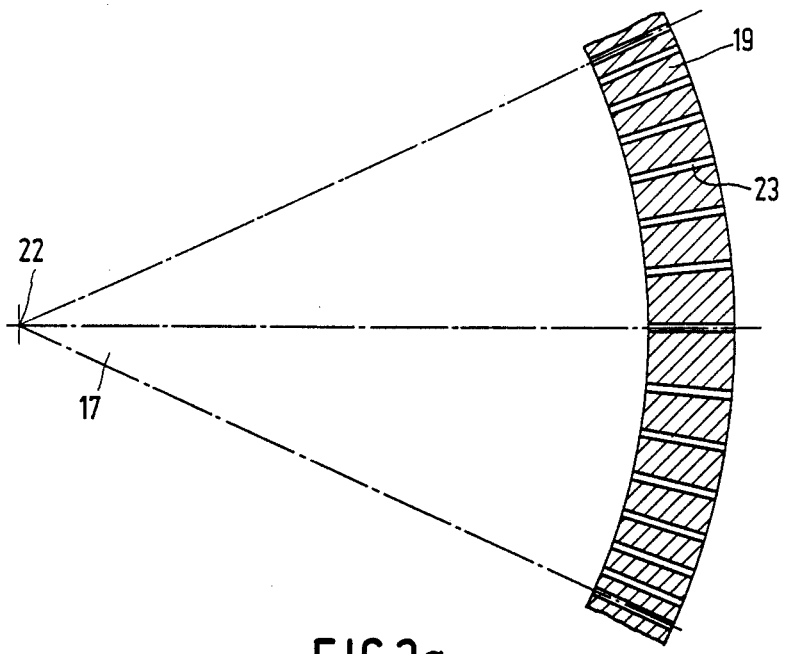

FIG. 3*a* is a cross-sectional view on an enlarged scale of stray radiation grid 19 the centre of curvature of which coincides with a focus 22 of the X-ray source and the connection line of which between the focus 22 and the centre of the perforation 23 is everywhere perpendicular to the plate surface of the stray radiation grid 19.

Figure 3B:
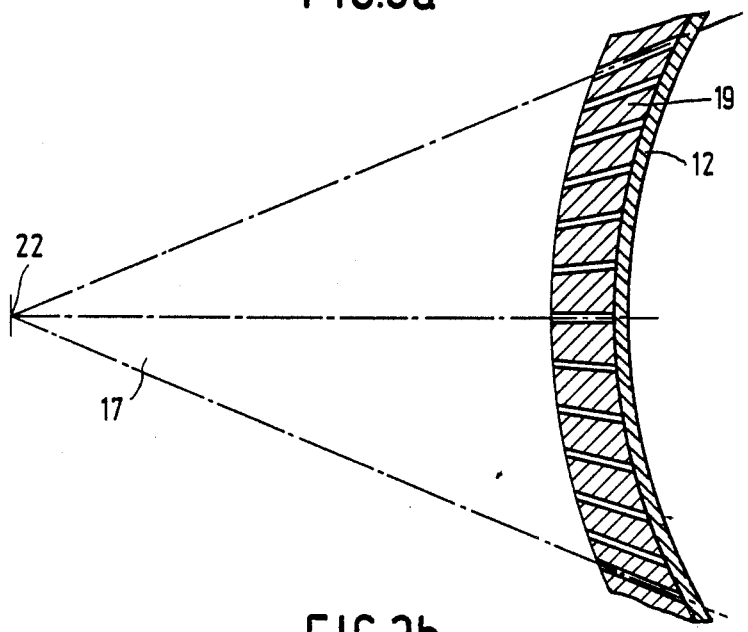

FIG. 3*b* is cross-sectional view on an enlarged scale of stray radiation grid 19 which is adapted to the curvature of the input screen 12. The focus of the perforations 23 coincides with the focal point 22 of the X-ray source.

I claim

1. In an X-ray examination apparatus of the type comprising:

X-ray source means which produce a divergent beam of X-rays which are directed through an object to be examined wherein the intensity of the X-ray beam which has passed through the object decreases as a function of distance from a centerline of the beam as a result of vignetting;

X-ray detecting means disposed in the beam of radiation which has passed through the object which produce an image therefrom;

a stray radiation grid disposed in the radiation beam between the object and the detecting means to reduce the intensity of secondary radiation incident upon the detector means, said grid comprising a plurality of absorbing regions which substantially absorb primary radiation in the radiation beam and a plurality of transmitting regions which transmit primary radiation in the radiation beam without substantial absorption; wherein, as an improvement the local ratio of the area of said transmitting regions to the area of said absorbing regions on the stray radiation grid increases as a function of distance from a nominal center of the beam to the edges of the grid in proportion to the intensity decrease resulting from vignetting, whereby the effects of vignetting are mitigated.

2. The apparatus of claim 1, wherein the radiation grid comprises a plate of radiation-absorbing material whicn is perforated to defing a plurality of X-ray transmitting holes.

3. The apparatus of claim 2, wherein the holes all have equal areas and wherein the pitch of the holes decreases as a function of distance from the center of the grid.

4. The apparatus of claim 2, wherein all of the holes are spaced at a constant pitch and wherein the area of the holes increases as a function of distance from the center of the grid.

5. The apparatus of claims 1, 2, 3 or 4 wherein the detecting means comprise an X-ray image intensifier tube having a curved input window and wherein the grid is curved in conformance with the window and is mounted against the window.

6. The apparatus of claim 1, wherein the radiation grid is formed a plurality of substantially parallel laminations of X-ray absorbing material which are spaced from one another with a pitch which increases as a function of distance from the center of the grid.

7. The apparatus of claim 1, wherein the radiation grid comprises a mesh of perpendicular X-ray absorbing laminations and wherein the pitch of the mesh increases as a function of distance from the center of the grid.

* * * * *